US011805582B2

(12) United States Patent
Chae

(10) Patent No.: US 11,805,582 B2
(45) Date of Patent: Oct. 31, 2023

(54) METHOD FOR CONTROLLING LAMP CIRCUIT BASED ON TEMPERATURE AND AMPLIFIED CURRENT AND LAMP CIRCUIT APPLYING THE SAME

(71) Applicant: HYUNDAI MOBIS CO., LTD., Gangnam-gu (KR)

(72) Inventor: Won Seok Chae, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/813,306

(22) Filed: Jul. 18, 2022

(65) Prior Publication Data

US 2023/0045435 A1 Feb. 9, 2023

(30) Foreign Application Priority Data

Aug. 3, 2021 (KR) ..... 10-2021-0102123

(51) Int. Cl.
*H05B 45/18* (2020.01)
*H05B 45/345* (2020.01)
*H05B 45/327* (2020.01)

(52) U.S. Cl.
CPC ..... *H05B 45/18* (2020.01); *H05B 45/327* (2020.01); *H05B 45/345* (2020.01)

(58) Field of Classification Search
CPC ..... H05B 45/18; H05B 45/32; H05B 45/56; H05B 45/325; H05B 45/345; H05B 45/3725; B60Q 1/1407; B60Q 1/1415; B60Q 1/2607
See application file for complete search history.

(56) References Cited

U.S. PATENT DOCUMENTS

| | | | | |
|---|---|---|---|---|
| 9,775,210 | B2 * | 9/2017 | Mishima | H05B 45/50 |
| 10,039,163 | B2 * | 7/2018 | Mishima | H05B 45/50 |
| 2007/0058366 | A1 | 3/2007 | West | |
| 2010/0079127 | A1 | 4/2010 | Grant | |
| 2011/0205770 | A1 * | 8/2011 | Isogai | H02M 1/32 363/78 |
| 2012/0062150 | A1 | 3/2012 | West | |
| 2012/0091907 | A1 | 4/2012 | Setomoto | |
| 2012/0176113 | A1 | 7/2012 | Grant | |

(Continued)

OTHER PUBLICATIONS

Extended European Search Report dated Dec. 15, 2022 issued in EP 22186244.4.

*Primary Examiner* — Tung X Le
(74) *Attorney, Agent, or Firm* — DLA PIPER LLP (US)

(57) ABSTRACT

A lamp circuit including a light emitting circuit and a light emission control circuit that controls the light emitting circuit. The light emitting circuit includes a thermistor and a light emitting device, and the light emission control circuit comprised a constant current circuit, dimming control circuit, voltage divider having a first resistor and a second resistor, and a current amplification circuit. The current amplification circuit amplifies a current of the thermistor, and the voltage divider divides a first voltage to a first node between the first resistor and the second resistor based on the amplified current. The dimming control circuit controls an output current of the constant current circuit based on the first voltage, and the constant current circuit outputs a current to the light emitting device based on the control of the dimming control circuit.

16 Claims, 5 Drawing Sheets

(56) References Cited

U.S. PATENT DOCUMENTS

| | | | | |
|---|---|---|---|---|
| 2012/0181931 | A1* | 7/2012 | Katsura | G01R 31/2635 315/77 |
| 2013/0127353 | A1* | 5/2013 | Athalye | H05B 45/35 315/193 |
| 2014/0340100 | A1* | 11/2014 | Popa | G01R 27/00 324/691 |
| 2014/0361693 | A1* | 12/2014 | Angelin | H05B 45/10 315/297 |
| 2015/0102725 | A1 | 4/2015 | West | |
| 2016/0262236 | A1 | 9/2016 | West | |
| 2018/0242421 | A1 | 8/2018 | Ohta | |
| 2018/0343722 | A1* | 11/2018 | Matsui | H05B 47/10 |
| 2021/0045205 | A1* | 2/2021 | Kanbara | F21S 41/155 |

* cited by examiner

METHOD FOR CONTROLLING LAMP CIRCUIT BASED ON TEMPERATURE AND AMPLIFIED CURRENT AND LAMP CIRCUIT APPLYING THE SAME

CROSS-REFERENCE TO RELATED APPLICATION

This application claims the benefit of priority to Korean Patent Application No. 10-2021-0102123, filed in the Korean Intellectual Property Office on Aug. 3, 2021, the entire contents of which are incorporated herein by reference.

TECHNICAL FIELD

The present disclosure relates to a method for controlling a lamp circuit based on a temperature and an amplified current and a lamp circuit applying the same.

BACKGROUND

Lights included in transportation such as vehicles include lamp circuits. When the light is left on state for a long time, the temperature of the light may increase. When the temperature of the light is continuously increased and the lamp circuit included in the light is exposed to high temperature, the light may be turned off. Therefore, to prevent the lamp circuit from being exposed to high temperature, the temperature of the lamp circuit should be appropriately maintained by controlling a current of a light emitting device included in the lamp circuit.

The lamp circuit may optionally include a micro controller unit (MCU). When the MCU is included in the lamp circuit, it is possible to actively control the thermistor included in the lamp circuit. Accordingly, it may be strong against external noise such as a radiated immunity (RI), a bulk current injection (BCI), and a radiated frequency immunity (RFI).

When the MCU is not included in the lamp circuit, it may be vulnerable to external noise such as the RI, the BCI, and the RFI. In addition, since the current of the light emitting device is controlled only through current characteristics according to the temperature of the thermistor and an on/off control of a diode, the lamp circuit that does not include the MCU may have a lower performance of controlling the current of the light emitting device compared to the lamp circuit including the MCU.

SUMMARY

The present disclosure has been made to solve the above-mentioned problems occurring in the prior art while advantages achieved by the prior art are maintained intact.

In a lamp circuit (hereinafter collectively referred to as a lamp circuit) that does not include an MCU, when the current of the light emitting device included in the light emitting circuit is controlled using a diode, the current of the light emitting device is controlled by using the diode characteristics and a change in the resistance value according to the temperature of a negative temperature coefficient thermistor (NTC). The negative temperature coefficient thermistor has a characteristic that the decrease rate of resistance value per unit temperature is slowed as the temperature increases. Therefore, when the lamp circuit is exposed to a high temperature, the rate of change of the current flowing through the thermistor may be slowed.

The lamp circuit controls the current of the light emitting device by feeding back the current flowing through the thermistor. Therefore, when the lamp circuit is exposed to a high temperature, the current change rate of the thermistor is slowed, so the current control of the light emitting element is not effective. To compensate for this, it is necessary to start the current control of the light emitting device from a relatively low temperature to prevent the current control effect of the light emitting device from falling at a high temperature. For this reason, the temperature range at which the dimming control circuit can uniformly control the brightness of the light emitting device is reduced. In addition, to prevent the lamp circuit from reaching a high temperature, it is necessary to make a large heat sink capable of receiving heat from the lamp circuit.

In addition, since the lamp circuit does not have an MCU capable of controlling noise, a filter is included in the lamp circuit to prevent being vulnerable to noise, thereby increasing the production cost.

An aspect of the present disclosure provides a method for controlling a lamp circuit based on a temperature and an amplified current and a lamp circuit applying the same.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, a lamp circuit includes a light emitting circuit and a light emission control circuit that controls the light emitting circuit. The light emitting circuit comprises a thermistor and a light emitting device, and the light emission control circuit includes a constant current circuit, dimming control circuit, voltage divider having a first resistor and a second resistor, and a current amplification circuit. The current amplification circuit amplifies a current of the thermistor, and the voltage divider divides a first voltage to a first node between the first resistor and the second resistor based on the amplified current. The dimming control circuit controls an output current of the constant current circuit based on the first voltage, and the constant current circuit outputs a current to the light emitting device based on the control of the dimming control circuit.

In addition, according to an aspect of the present disclosure, a method for controlling a lamp circuit includes amplifying, by a current amplification circuit, a current of a thermistor, dividing, by a voltage divider, a first voltage based on the amplified current, and controlling, by a dimming control circuit, an output current of a constant current circuit based on the first voltage.

BRIEF DESCRIPTION OF THE DRAWINGS

The above and other objects, features and advantages of the present disclosure will be more apparent from the following detailed description taken in conjunction with the accompanying drawings.

In connection with the description of the drawings, the same or similar reference numerals may be used for the same or similar components.

DETAILED DESCRIPTION

Figure 1:
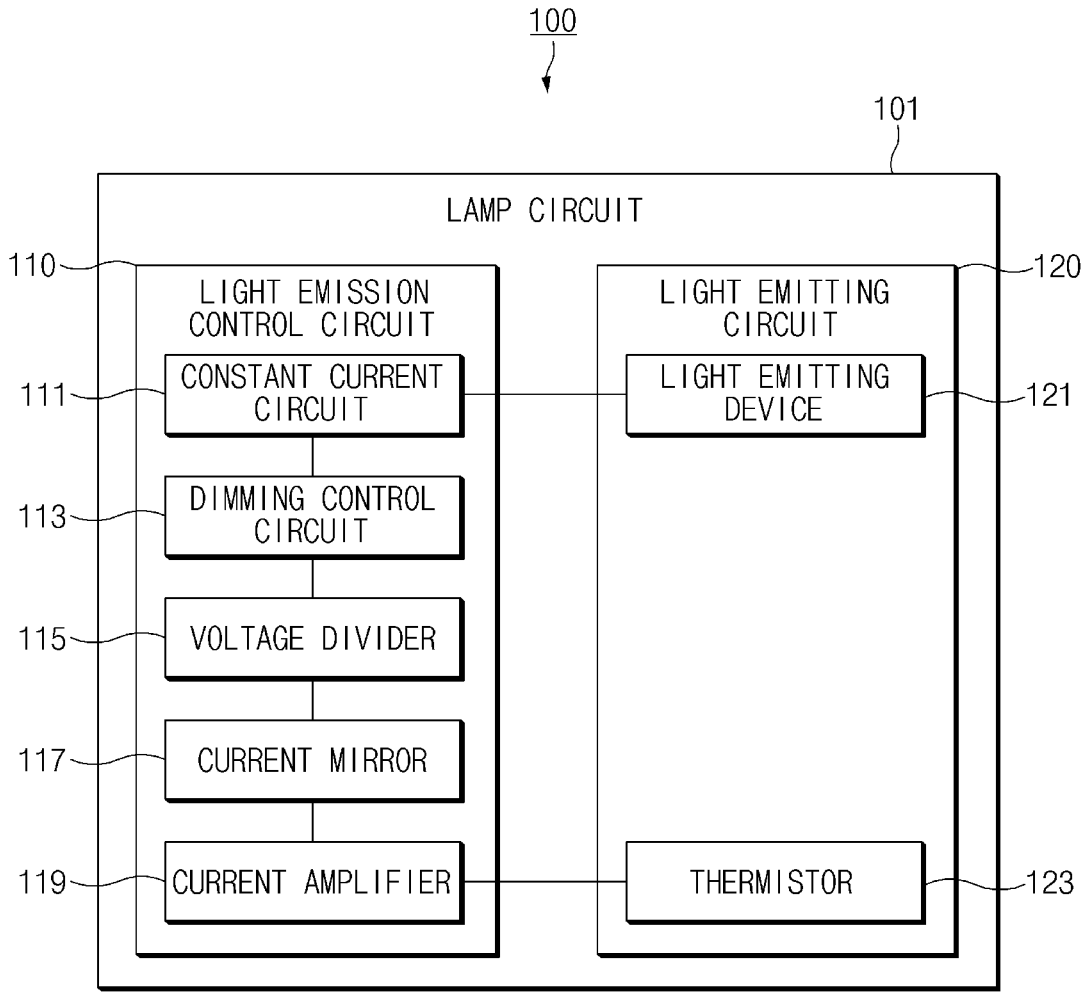
FIG. 1 is a block diagram of a lamp circuit according to various embodiments.

Hereinafter, various embodiments of the disclosure will be described with reference to accompanying drawings. However, those of ordinary skill in the art will recognize that modification, equivalent, and/or alternative on various embodiments described herein can be variously made without departing from the scope and spirit of the disclosure.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related components. It is to be understood that a singular form of a noun corresponding to an item may include one or more of the things, unless the relevant context clearly indicates otherwise. As used herein, each of such phrases as "A or B", "at least one of A and B", "at least one of A or B", "A, B, or C", "at least one of A, B, and C", and "at least one of A, B, or C" may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that when a component (e.g., a first component) is referred to, with or without the term "functionally" or "communicatively", as "coupled" or "connected" to another component (e.g., a second component), it means that the component may be coupled with the other component directly (e.g., wiredly), wirelessly, or via a third component.

As used in connection with various embodiments of the disclosure, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

According to various embodiments, each component (e.g., a module or a program) of the above-described components may include a single entity or multiple entities, and some of the multiple entities may be separately disposed in different components. According to various embodiments, one or more of the above-described components may be omitted, or one or more other components may be added. Alternatively or additionally, a plurality of components (e.g., modules or programs) may be integrated into a single component. In this case, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

FIG. 1 is a block diagram of a lamp circuit according to various embodiments.

According to an embodiment, a lamp circuit 101 may include a light emission control circuit 110 and a light emitting circuit 120. The light emission control circuit 110 may include a constant current circuit 111, a dimming control circuit 113, a voltage divider 115, and a current amplification circuit (not illustrated). The current amplification circuit (not illustrated) may include a current mirror 117 and a current amplifier 119. The current amplifier 119 may be collectively referred to as an amplifying transistor. The light emitting circuit 120 may include a light emitting device 121 and a thermistor 123.

The current amplifier 119 may receive a current of the thermistor 123, may amplify the current of the thermistor 123, and may output it to the current mirror 117. The current mirror 117 may receive the amplified current and may copy the amplified current. The voltage divider 115 may divide the voltage to a first node (e.g., a first node N1 of FIG. 2A) based on the copied current. The dimming control circuit 113 may control an output current of the constant current circuit 111 based on the voltage of the first node N1. The constant current circuit 111 may output a current to the light emitting device 121.

Figure 2A:
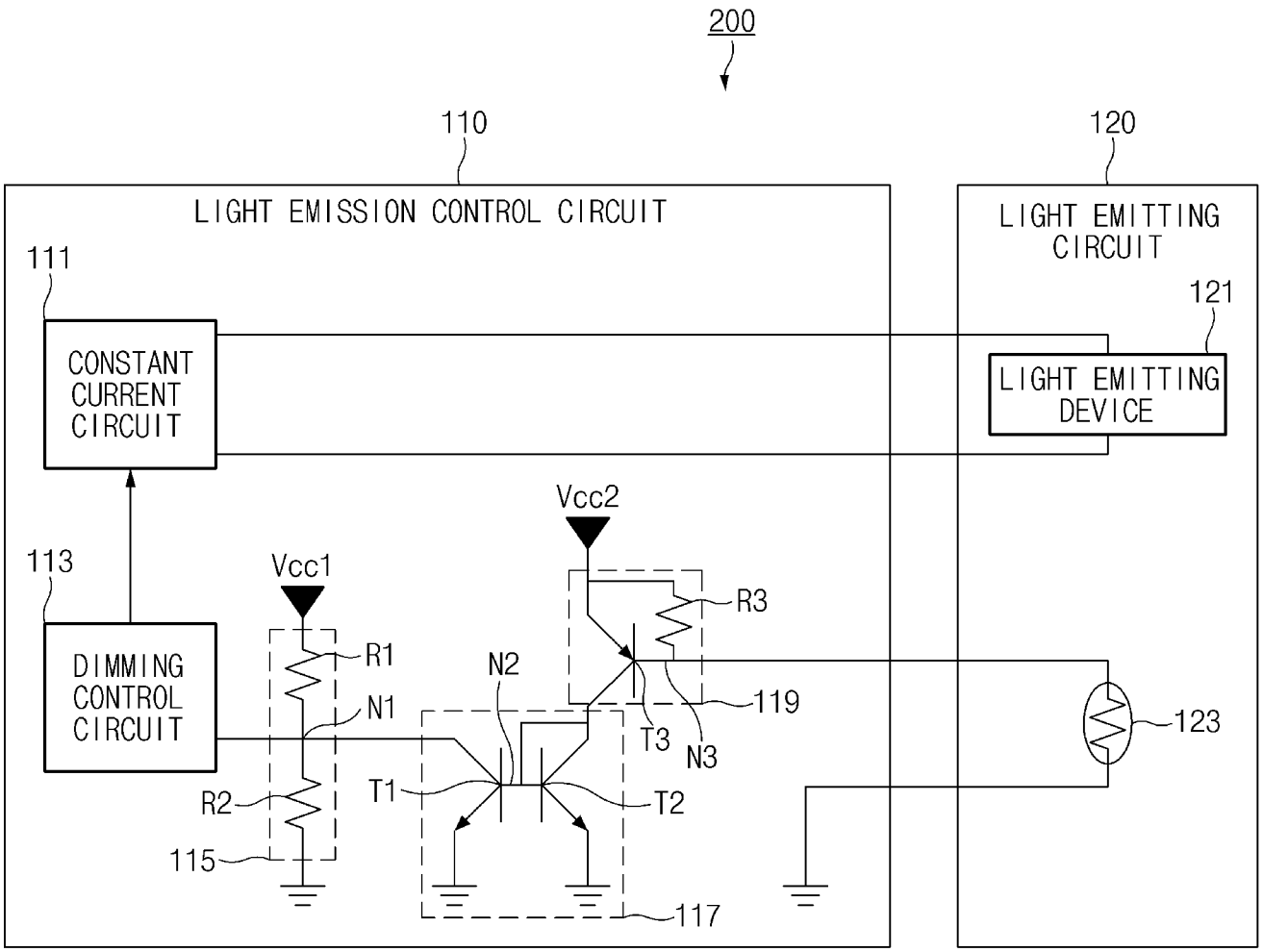
FIG. 2A is a circuit diagram of a lamp circuit according to various embodiments.

FIG. 2A is a circuit diagram of a lamp circuit according to various embodiments.

According to an embodiment, the current mirror 117 may include a first transistor T1 and a second transistor T2. The voltage divider 115 may include a first resistor R1 and a second resistor R2.

The first node N1 may be electrically connected to the dimming control circuit 113, the first resistor R1, the second resistor R2, and a collector of the first transistor T1. A second node N2 may be electrically connected to a base of the first transistor T1, a base of the second transistor T2, a collector of the second transistor T2, and a collector of the current amplifier 119. A third node N3 may be electrically connected to a base of the current amplifier 119, the third resistor R3, and the thermistor 123.

One end of the thermistor 123 may be grounded to the ground. The other end of the thermistor 123 may be electrically connected to the third node N3. The third node N3 may be electrically connected to the base of the current amplifier 119, the third resistor R3, and the thermistor 123. One end of the third resistor R3 may be electrically connected to the third node N3. The other end of the third resistor R3 may be electrically connected to an emitter of the current amplifier 119. A second driving voltage Vcc2 may be supplied to the emitter of the current amplifier 119.

The collector of the current amplifier 119 may be electrically connected to the second node N2. The second node N2 may be electrically connected to the base of the first transistor T1, the base of the second transistor T2, the collector of the second transistor T2, and the collector of the current amplifier 119. An emitter of the second transistor T2 may be grounded to the ground. An emitter of the first transistor T1 may be grounded to the ground. The collector of the first transistor T1 may be electrically connected to the first node N1.

The first node N1 may be electrically connected to the dimming control circuit 113, the first resistor R1, the second resistor R2, and the collector of the first transistor T1. One end of the second resistor R2 may be electrically connected to the first node N1. The other end of the second resistor R2 may be grounded to the ground. One end of the first resistor R1 may be electrically connected to the first node N1. A first driving voltage Vcc1 may be supplied to the other end of the first resistor R1.

The dimming control circuit 113 may be electrically connected to the first node N1 and the constant current circuit 111. The constant current circuit 111 may be electrically connected to the dimming control circuit 113 and the light emitting device 121.

According to an embodiment, the current amplifier 119 may amplify a current flowing through the thermistor 123 and output it to the second transistor T2. The first transistor T1 may copy the current of the collector of the second transistor T2. Based on the voltage value of the first node N1 determined according to the copied current value, the dimming control circuit 113 may control an output current of the constant current circuit 111. The constant current circuit 111 may output a current to the light emitting device 121. The output current of the constant current circuit 111 may correspond to a current of the light emitting device 121.

Figure 2B:
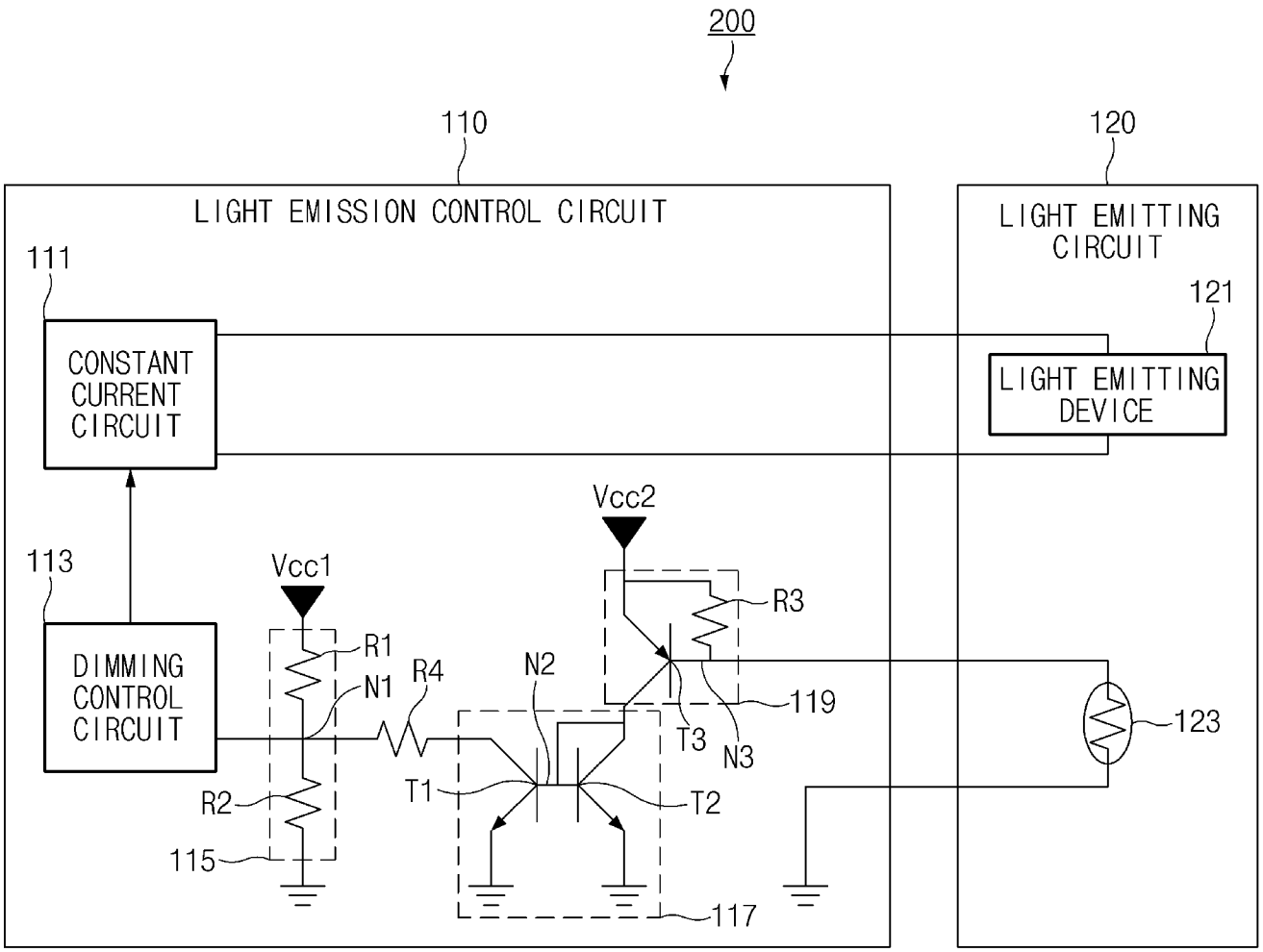
FIG. 2B is a circuit diagram of a lamp circuit including a fourth resistor according to various embodiments.

FIG. 2B is a circuit diagram of a lamp circuit including a fourth resistor according to various embodiments. Description of the actually identical configuration and/or operation having actually the same configuration as that of FIG. 2A will be omitted to avoid redundancy.

According to an embodiment, a fourth resistor may be selectively disposed between the first node N1 and the collector of the first transistor T1. The fourth resistor may electrically connect between the first node N1 and the collector of the first transistor T1. By disposing the fourth resistor, it is possible to prevent the dimming control circuit 113 from controlling the output current of the constant current circuit 111 to 0 mA.

According to an embodiment, when the temperature of the lamp circuit (e.g., the lamp circuit 101 of FIG. 1) increases, the resistance value of the thermistor 123 may decrease, such that the current flowing through the thermistor 123 may increase. The current amplifier 119 may amplify the increased current of the thermistor 123. The current mirror 117 may copy the amplified current. As the amount of current transferred from the first node N1 to the current mirror 117 increases, the voltage value of the first node N1 may decrease.

When the fourth resistor is added, the sum of the voltage of the collector of the first transistor T1 and the voltage of the fourth resistor may correspond to the voltage of the first node N1. Compared to the voltage of the first node N1 in the absence of the fourth resistor, the voltage of the first node N1 in the presence of the fourth resistor may have a relatively large value.

Figure 3:
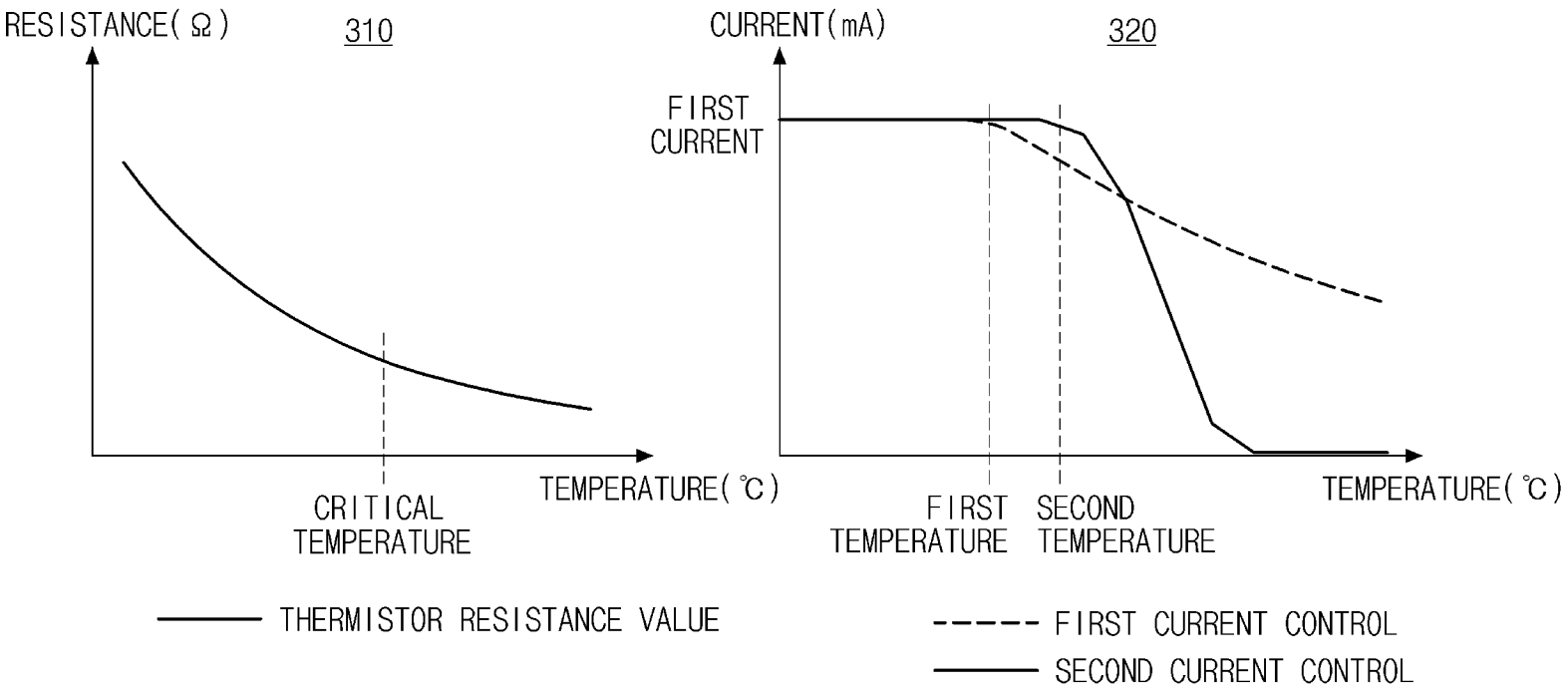
FIG. 3 is an operation graph of a lamp circuit according to various embodiments.

FIG. 3 is an operation graph of a lamp circuit according to various embodiments.

According to an embodiment, a graph 310 may indicate a change (hereinafter, collectively referred to as "temperature characteristics of the thermistor 123") in the resistance value of the thermistor 123 according to the temperature of the thermistor (e.g., the thermistor 123 of FIG. 1). In the graph 310, as the temperature of the thermistor 123 increases, it may be seen that the decrease in the resistance value of the thermistor 123 at a temperature above a critical temperature is slowed.

According to an embodiment, a graph 320 may indicate that the dimming control circuit (e.g., the dimming control circuit 113 of FIG. 1) controls the current of the light emitting device 121 depending on the temperature of the thermistor 123. A first current control may represent a curve in which the dimming control circuit 113 controls the current of the light emitting device (e.g., the light emitting device 121 of FIG. 1) when the current amplifier (e.g., the current amplifier 119 of FIG. 1) is not included in the lamp circuit (e.g., the lamp circuit 101 of FIG. 1). A second current control may represent a curve in which the dimming control circuit 113 controls the current of the light emitting device 121 when the current amplifier 119 is included in the lamp circuit 101. In the first current control, the current of the light emitting device 121 may be controlled by a first current at a first temperature or less. In the second current control, the current of the light emitting device 121 may be controlled by a first current at a second temperature or less.

According to an embodiment, in the first current control, the dimming control circuit 113 may use the unamplified current of the thermistor 123 to control the current of the constant current circuit (e.g., the constant current circuit 111 in FIG. 1). As the change in the resistance value of the thermistor 123 is slowed at a temperature higher than the critical temperature (e.g., the critical temperature of the graph 310), the change in the current value of the thermistor 123 may be slowed at a temperature higher than the critical temperature. As the change in the current value of the thermistor 123 is slowed, the change in the voltage value of the first node N1 may be slowed.

Since the dimming control circuit 113 controls the constant current circuit 111 based on the voltage value of the first node N1, a change in the current control value of the light emitting device 121 per unit temperature may be reduced. Since the current control value of the light emitting device 121 per unit temperature decreases, the dimming control circuit 113 may decrease the current of the light emitting device 121 from the first temperature.

According to an embodiment, in the second current control, the dimming control circuit 113 may control the current of the constant current circuit 111 using the amplified current of the thermistor 123. Although the change in the resistance value of the thermistor 123 and the change in the current value of the thermistor 123 are slowed at a temperature above the critical temperature, the change in the voltage value of the first node N1 may not be slowed by amplifying the current of the thermistor 123. Since the dimming control circuit 113 controls the constant current circuit 111 based on the voltage value of the first node N1, a change in the current control value of the light emitting device 121 per unit temperature may not be reduced.

Compared to the first current control, it is relatively easy to control the current of the light emitting device 121 per unit temperature of the second current control, such that in the second current control, the current of the light emitting device 121 may be reduced from the second temperature. According to an embodiment, the range of the temperature at which the dimming control circuit 113 controls the output current of the constant current circuit 111 with the first current in the second current control may be increased compared to the range of the temperature at which the dimming control circuit 113 controls the output current of the constant current circuit 111 with the first current in the first current control.

Figure 4:
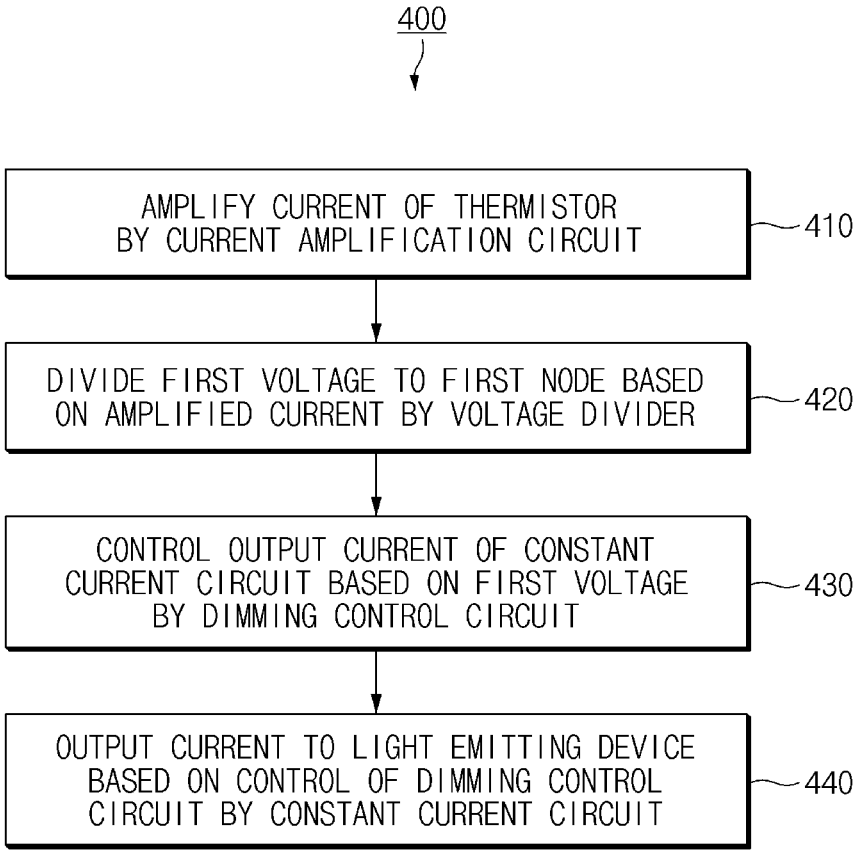
FIG. 4 is an operation flowchart of a lamp circuit according to various embodiments.

FIG. 4 is an operation flowchart of a lamp circuit according to various embodiments.

According to an embodiment, in operation 410, the current amplification circuit may amplify a current of the thermistor (e.g., the thermistor 123 of FIG. 1). The current amplification circuit may include a current mirror (e.g., the current mirror 117 of FIG. 1) and a current amplifier (e.g., the current amplifier 119 of FIG. 1). In operation 420, the voltage divider (e.g., the voltage divider 115 of FIG. 1) may divide the first voltage to the first node (e.g., the first node N1 of FIG. 2A) based on the amplified current. In operation 430, the dimming control circuit (e.g., the dimming control circuit 113 of FIG. 1) may control an output current of the constant current circuit (e.g., the constant current circuit 111 of FIG. 1) based on the first voltage. In operation 440, the constant current circuit 111 may output a current to the light emitting device (e.g., the light emitting device 121 of FIG. 1) based on the control of the dimming control circuit 113.

According to an embodiment of the present disclosure, it is possible to easily control the current of the light emitting device at a high temperature by amplifying the current of the thermistor using a transistor and then using the amplified current.

As current control at a high temperature becomes easier, it is possible not to start controlling the current of the lamp circuit from a low temperature. Accordingly, the range of the temperature at which the current of the light emitting device is uniformly output may be increased.

As the current of the light emitting device can be effectively controlled at a high temperature, a heat sink, which is a component for preventing the lamp circuit from reaching a high temperature state, may be made relatively small.

In addition, various effects directly or indirectly identified through this document may be provided.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A lamp circuit comprising:

a light emitting circuit; and a light emission control circuit configured to control the light emitting circuit, wherein the light emitting circuit comprises a thermistor and a light emitting device, wherein the light emission control circuit comprises a constant current circuit, a dimming control circuit, a voltage divider having a first resistor and a second resistor, and a current amplification circuit, wherein the current amplification circuit amplifies a current of the thermistor, wherein the current amplification circuit comprises a current mirror and an amplifying transistor connected to the thermistor, wherein the current mirror comprises a first transistor and a second transistor, wherein a base of the amplifying transistor is connected to the thermistor and an emitter of the amplifying transistor, wherein a collector of the amplifying transistor is connected to a base of the first transistor, a base of the second transistor, and a collector of the second transistor, wherein the voltage divider divides a first voltage to a first node between the first resistor and the second resistor based on the amplified current, wherein the dimming control circuit controls an output current of the constant current circuit based on the first voltage, and wherein the constant current circuit outputs the output current to the light emitting device based on the control of the dimming control circuit.

2. The lamp circuit of claim 1, wherein the first transistor and the second transistor are NPN transistors.

3. The lamp circuit of claim 1, wherein:

the collector of the second transistor is connected to the collector of the amplifying transistor, the base of the first transistor, and the base of the second transistor, an emitter of the first transistor and an emitter of the second transistor are grounded, and a collector of the first transistor is connected to the voltage divider.

4. The lamp circuit of claim 3, further comprising:

a resistor disposed in series between the collector of the first transistor and the voltage divider.

5. The lamp circuit of claim 1, wherein an input of the dimming control circuit is connected to the voltage divider, and an output of the dimming control circuit is connected to the constant current circuit.

6. The lamp circuit of claim 1, wherein an input of the constant current circuit is connected to the dimming control circuit, and an output of the constant current circuit is connected to the light emitting device.

7. The lamp circuit of claim 1, wherein the thermistor is a negative temperature coefficient thermistor (NTC) of which a resistance value decreases when a temperature of the thermistor increases.

8. The lamp circuit of claim 1, wherein the dimming control circuit allows the output current of the constant current circuit to be reduced when the first voltage is below a critical voltage.

9. The lamp circuit of claim 1, wherein a driving voltage is supplied to a collector of the amplifying transistor.

10. The lamp circuit of claim 1, wherein a driving voltage is supplied to the first resistor of the voltage divider.

11. The lamp circuit of claim 1, wherein the dimming control circuit is an analog dimming control circuit.

12. A method of controlling a lamp circuit, the method comprising:

amplifying, by a current amplification circuit, a current of a thermistor, the current amplification circuit comprising:

a current mirror and an amplifying transistor connected to the thermistor, the current mirror comprising a first transistor and a second transistor, a base of the amplifying transistor being connected to the thermistor and an emitter of the amplifying transistor, and a collector of the amplifying transistor being connected to a base of the first transistor, a base of the second transistor, and a collector of the second transistor, dividing, by a voltage divider, a first voltage based on the amplified current; and controlling, by a dimming control circuit, an output current of a constant current circuit based on the first voltage.

13. The method of claim 12, wherein amplifying of the current of the thermistor comprises:

amplifying the current of the thermistor by the amplifying transistor; and mirroring the amplified current by the current mirror.

14. The method of claim 12, wherein the controlling of the output current allows the output current to be reduced when the first voltage is less than or equal to a critical voltage.

15. The method of claim 12, wherein the first voltage corresponds to a voltage of a first node between a first resistor and a second resistor included in the voltage divider.

16. The method of claim 12, wherein the thermistor is a negative temperature coefficient thermistor (NTC) of which a resistance value decreases when a temperature of the thermistor increases.

* * * * *